US007213376B2

(12) United States Patent
Pulkkanen et al.

(10) Patent No.: US 7,213,376 B2
(45) Date of Patent: May 8, 2007

(54) BRACKET FOR SUPPORTING STRUCTURAL ELEMENT TO SUPPORT STRUCTURE

(75) Inventors: Juha Pulkkanen, Lahti (FI); Pekka Hayrinen, Helsinki (FI); Taru Leinonen, Kerava (FI); Kimmo Varvikko, Lahti (FI); Kari Tuominen, Lahti (FI); Jorma Kinnunen, Lahti (FI)

(73) Assignee: Teraspeikko Oy, Lahti (FI)

( * ) Notice: Subject to any disclaimer, the term of this patent is extended or adjusted under 35 U.S.C. 154(b) by 254 days.

(21) Appl. No.: 10/381,494

(22) PCT Filed: Oct. 17, 2001

(86) PCT No.: PCT/FI01/00901

§ 371 (c)(1),
(2), (4) Date: Sep. 22, 2003

(87) PCT Pub. No.: WO02/33185

PCT Pub. Date: Apr. 25, 2002

(65) Prior Publication Data

US 2004/0050012 A1 Mar. 18, 2004

(30) Foreign Application Priority Data

Oct. 18, 2000 (FI) ..... 20002303

(51) Int. Cl.
*E04B 1/21* (2006.01)
*E04B 1/38* (2006.01)

(52) U.S. Cl. ..... 52/283; 52/702; 52/704; 52/707

(58) Field of Classification Search ..... 52/707, 52/698, 223.8, 223.11, 712, 231, 125.4, 223.12, 52/223.9, 223.13, 168, 702, 704, 709, 710, 52/713, 251, 289, 283; 403/408.1, 364; 411/82, 411/84, 101, 102, 539
See application file for complete search history.

(56) References Cited

U.S. PATENT DOCUMENTS

| | | | | | |
|---|---|---|---|---|---|
| 2,027,888 | A | * | 1/1936 | Solomon | 16/249 |
| 2,423,936 | A | * | 7/1947 | Henderson | 52/283 |
| 2,581,104 | A | * | 1/1952 | Houlsby, Jr. | 16/249 |
| 2,611,667 | A | * | 9/1952 | Lampe | 384/368 |
| 2,615,194 | A | * | 10/1952 | Kreiner | 16/248 |
| 2,952,947 | A | * | 9/1960 | White | 52/708 |
| 3,507,315 | A | * | 4/1970 | Tummarello | 411/103 |
| 3,513,610 | A | * | 5/1970 | Devonport | 52/283 |
| 3,640,328 | A | * | 2/1972 | Tummarello | 411/103 |

(Continued)

FOREIGN PATENT DOCUMENTS

DE 2 263 403 6/1974

(Continued)

*Primary Examiner*—Robert Canfield
(74) *Attorney, Agent, or Firm*—Young & Thompson

(57) ABSTRACT

A bracket for supporting a structural element, such as a precast concrete beam, on a concrete pile or similar support structure in a building includes a first support part (1) which is cast at least partly into the concrete pile. The first support part (1) includes a bracket part (5) for supporting the structural element so that the structural element bears against the concrete pile. The bracket part (5) is movably fastened to the first support part (1), which is cast at least partly into the concrete pile, such that the position of the bracket part (5) with regard to the concrete pile can be changed.

3 Claims, 3 Drawing Sheets

U.S. PATENT DOCUMENTS

| | | | | |
|---|---|---|---|---|
| 4,214,444 | A * | 7/1980 | Fujioka et al. | 60/322 |
| 4,249,878 | A * | 2/1981 | Komarek | 425/237 |
| 4,621,962 | A * | 11/1986 | Rozniecki | 411/368 |
| 4,819,394 | A * | 4/1989 | Compton | 52/252 |
| 4,905,444 | A * | 3/1990 | Semaan et al. | 52/710 |
| 4,969,788 | A * | 11/1990 | Goiny | 411/428 |
| 5,479,748 | A * | 1/1996 | Siller | 52/231 |
| 5,548,939 | A * | 8/1996 | Carmical | 52/707 |
| 5,711,122 | A * | 1/1998 | Lee | 52/283 |
| 5,729,951 | A * | 3/1998 | Frohlich | 52/698 |
| 5,846,018 | A * | 12/1998 | Frobosilo et al. | 403/403 |
| 6,010,045 | A * | 1/2000 | Rogers et al. | 224/198 |
| 6,213,679 | B1 * | 4/2001 | Frobosilo et al. | 403/403 |
| 6,298,629 | B1 * | 10/2001 | Ador | 52/698 |
| 6,298,630 | B1 * | 10/2001 | VeRost et al. | 52/712 |
| 6,327,854 | B1 * | 12/2001 | Bonny et al. | 60/323 |
| 6,647,674 | B1 * | 11/2003 | Lancelot et al. | 52/125.4 |
| 6,679,017 | B2 * | 1/2004 | Woodruff et al. | 52/283 |
| 2005/0039414 | A1 * | 2/2005 | Miller et al. | 52/698 |
| 2005/0102958 | A1 * | 5/2005 | Anderson | 52/698 |

FOREIGN PATENT DOCUMENTS

| | | |
|---|---|---|
| DE | 33 42 380 | 6/1985 |
| EP | 0 101 984 | 3/1984 |
| EP | 0 423 660 | 4/1991 |
| EP | 0 728 875 | 8/1996 |
| FI | RN901 | 9/1993 |
| FI | 960094 | 7/1997 |
| GB | 1 374 546 | 11/1974 |
| GB | 2 234 540 | 2/1991 |

* cited by examiner

BRACKET FOR SUPPORTING STRUCTURAL ELEMENT TO SUPPORT STRUCTURE

FIELD OF THE INVENTION

The invention relates to a bracket for supporting a structural element, such as a precast concrete beam, on a concrete pile or a similar support structure of a building, the bracket comprising a first support part which is cast at least partly into the concrete pile, the first support part comprising a bracket part for supporting the structural element so that the structural element bears against the concrete pile, the first support part comprising threaded holes for bolts and the bracket part comprising through-holes through which the bolts are driven, the bracket part being movably fastened with the bolts to the first support part, which is cast at least partly into the concrete pile, such that the position of the bracket part with regard to the concrete pile can be changed.

A problem with some known brackets is that they do not comprise a proper arrangement to allow for other adjustments than those made in the longitudinal direction of the beam. As a result, errors in casting, for example, cannot be corrected. A concrete pile is usually provided with a first support part that is cast at least partly into the concrete pile and if the first support part is slanting or misplaced in the concrete pile, for example when one end of the precast concrete beam is being mounted to the concrete pile, such errors cannot be corrected.

A solution to this problem has been proposed in FI 960094 which teaches a bracket part the position of which can be changed in the vertical direction with regard to a first support part cast into a pile or the like. A problem with this known solution, however, is that it only enables vertical adjustment.

BRIEF DESCRIPTION OF THE INVENTION

It is therefore an object of the invention to provide a bracket that solves the above problems.

The object of the invention is achieved by a bracket characterized in that the inner diameter of the through-holes is greater than the outer diameter of the bolts such that when the bolts have been screwed to the threaded holes, the bracket part can be moved with regard to the first support part.

The preferred embodiments of the invention are disclosed in the dependent claims.

An underlying idea of the invention is that the bracket part is movably arranged to the first support part to be cast into the concrete pile. This enables the bracket part to be moved with regard to the concrete pile at the construction site when one end of the concrete beam is mounted onto the bracket part, thereby enabling errors, if any, in casting and in the position of the concrete pile to be corrected at the construction site.

An advantage of the bracket of the invention is that greater precision is achieved in the mounting of a construction unit with regard to the concrete pile.

Since the inner diameter of the through-holes in the bracket part is greater than the outer diameter of the bolts in the holes, the solution of the invention allows a two-dimensional movement to take place, i.e. with the bolts screwed through the holes in the bracket part and screwed to the threaded holes in the first support part, the bracket part can be moved both in horizontal and vertical directions with regard to the concrete pile and the first support part cast at least partly into the pile.

Since the inner diameter of the through-holes in the bracket part is greater than the outer diameter of the bolts in the holes, the solution of the invention also allows the angle between the bracket part and the concrete pile to be adjusted, if necessary.

A bracket part in a first preferred embodiment of the bracket of the invention comprises a first preformed surface, which is arranged to co-operate with a second preformed surface of the first support part. Through the first and second preformed surfaces, the vertical force component caused by the concrete beam to the bracket part is preferably transferred to the concrete pile.

Further, a preferred embodiment of the bracket of the invention comprises adjustment means for adjusting the structural element and for fastening it immovably with regard to the bracket part. This solution allows torsion originating from the beam to be transferred to the concrete pile.

In a preferred embodiment of the bracket of the invention, the first support part comprises a stopper that is arranged to secure the structural element to the bracket part. This stopper is arranged to receive the horizontal forces caused by the concrete beam to the first support part.

BRIEF DESCRIPTION OF THE DRAWINGS

In the following, the invention will be described in greater detail with reference to the preferred embodiments and the accompanying drawings, in which.

DETAILED DESCRIPTION OF THE INVENTION

The Figures show a bracket for supporting a structural element, such as a concrete beam, on a support structure in a building. The structural element may also be made of some other material than concrete, such as steel.

Figure 1:
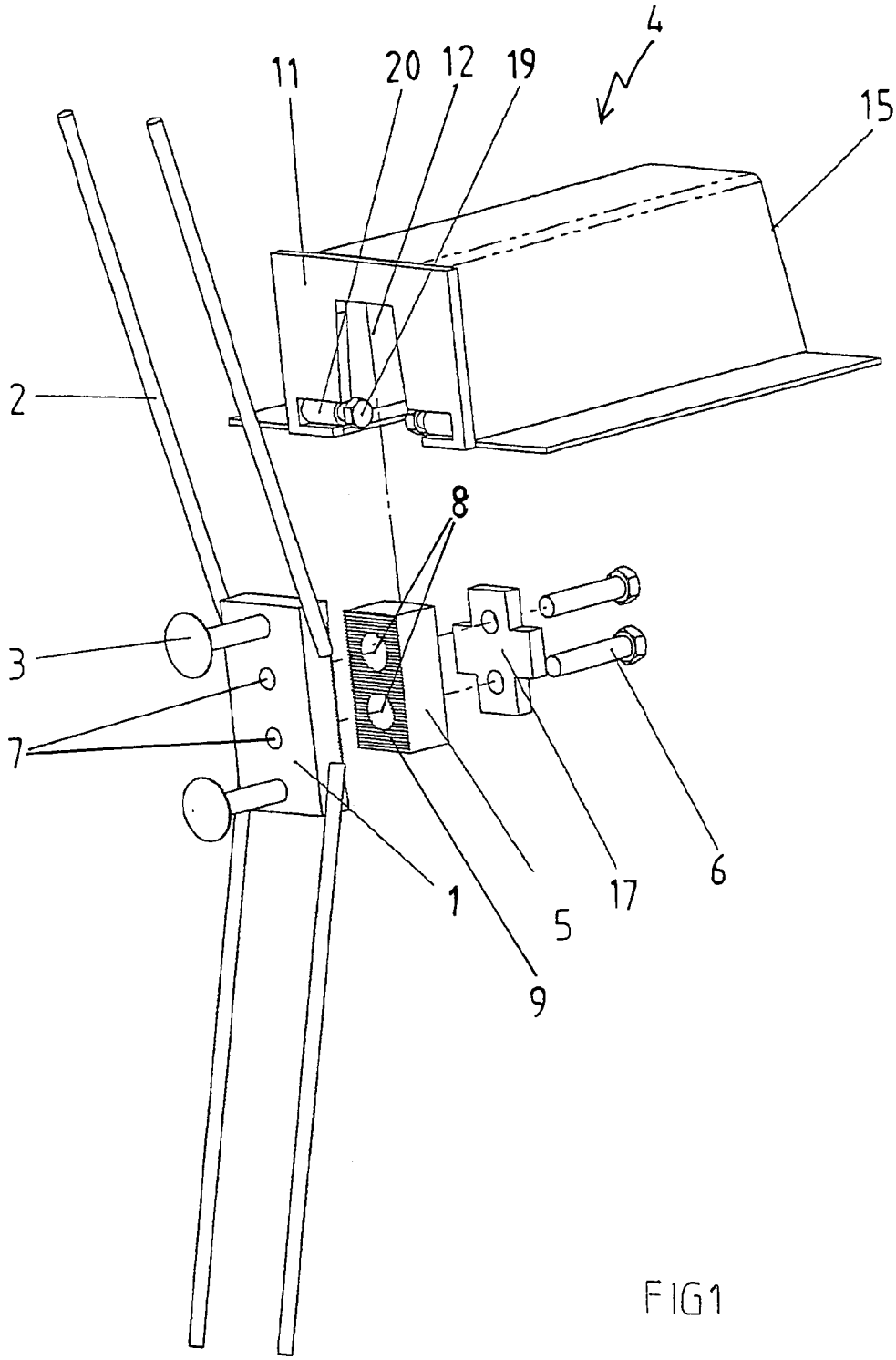
FIG. 1 shows a disassembled bracket.
Figure 2:
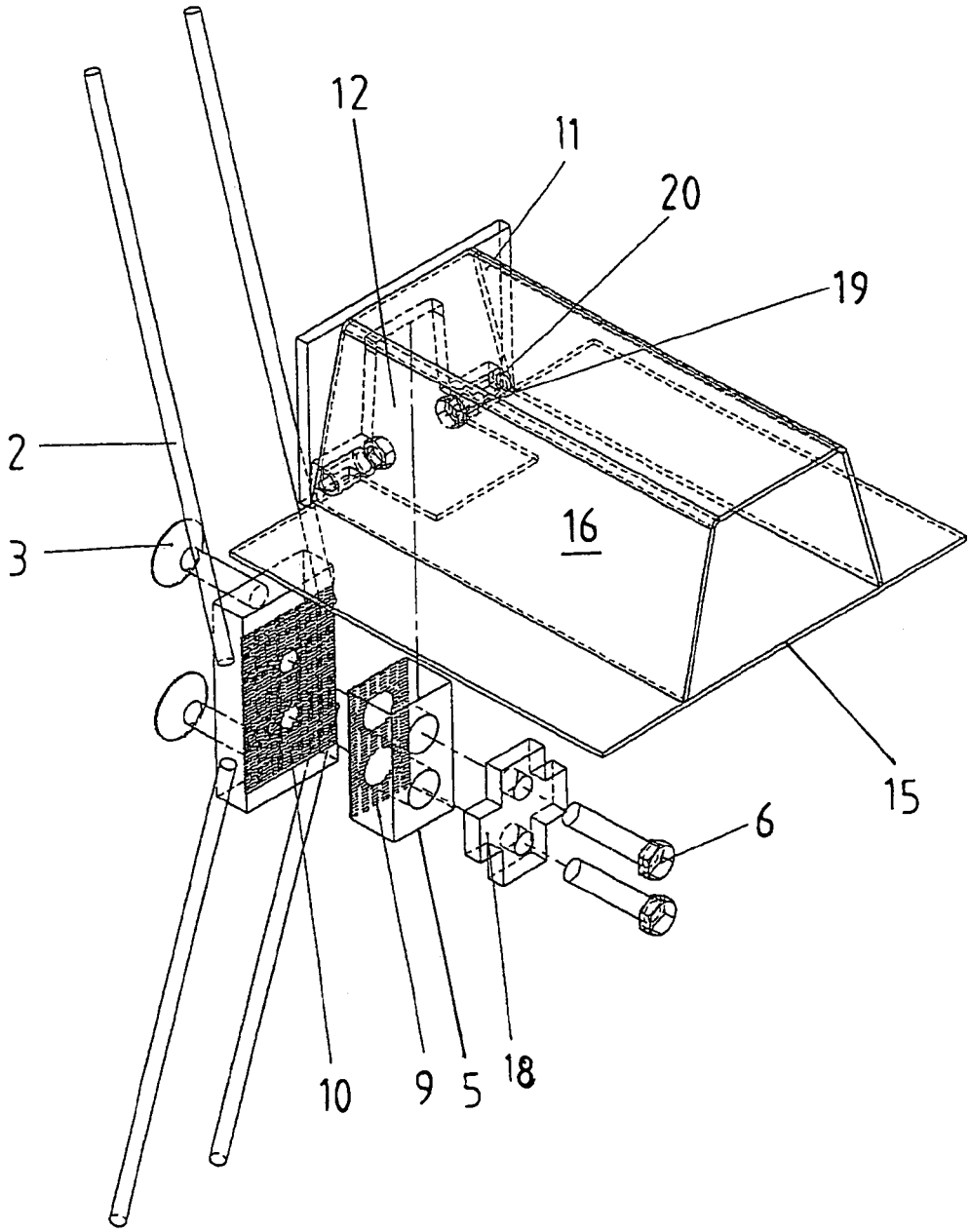
FIG. 2 shows a disassembled bracket.
Figures 3, 4, 5:
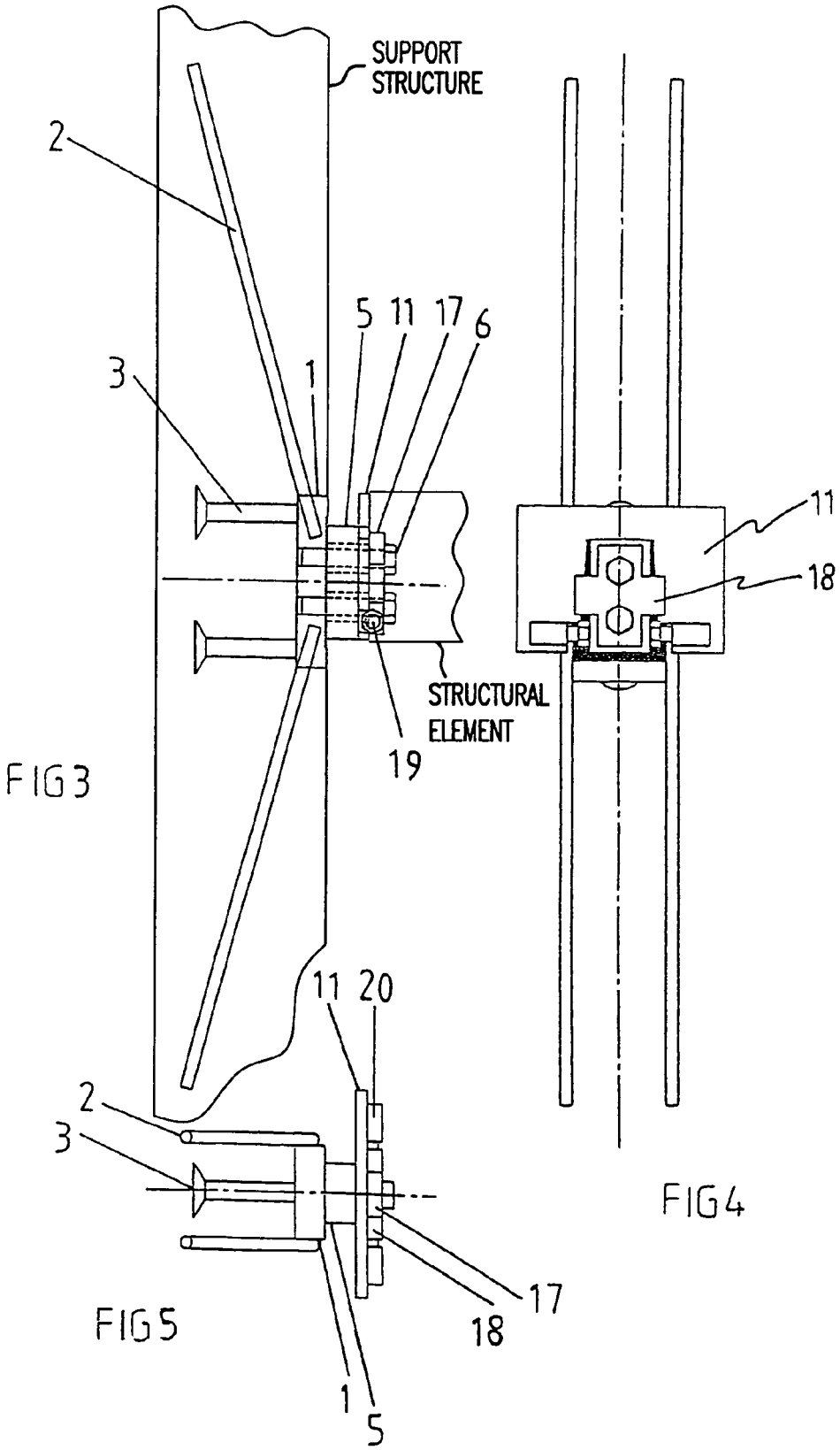
FIG. 3 is a side view of the bracket.
FIG. 4 is a view of the bracket as seen from the structural element.
FIG. 5 is a top view of the bracket.

The bracket comprises a first support part 1 which is meant to be cast at least partly into the support structure as shown in FIG. 3. In the Figures the first support part 1 is a rectangular plate part.

The first support part 1 shown in the Figures is provided with bonds 2 and 3 fastened thereto for anchoring the first support part 1 to the support structure. In the Figures the bonds are deformed steel bars 2 and headed pins 3. The deformed steel bars 2 are arranged in a slanting position such that the continuations (not shown) of the centre lines of the deformed steel bars 2 intersect outside the support structure. This preferred positioning of the deformed steel bars 2 allows the strain caused by the eccentricity of shear force to be reduced.

The bracket shown in the Figures further comprises a second support part 4 which is meant to be cast at least partly into the structural element. It is also possible that the structural element is shaped, i.e. cast, such that it can be supported on the first support part 1. For example, the structural element may comprise a recess (not shown).

The first support part 1 comprises a bracket part 5 on which the structural element can be supported such that the structural element bears against the support structure. The structural element shown in the Figures is supported on the bracket part 5 through the second support part 4 cast into the structural element. Apart from the bracket part 5, the first support part 1 of the Figures is to be cast substantially entirely into the support structure. The first support part 1 of the Figures is to be cast into the support structure to form part of the outer surface of the support structure. The portion of the first support part 1 remaining outside the support structure may be protected by shrink plastic, for example, for the duration of the casting.

The bracket part 5 is movably arranged to the first support part 1 such that the position of the bracket part 5 with regard to the support structure may be changed.

In the Figures the bracket part 5 is detachably fastened to the first support part 1 with bolts 6. The first support part 1 comprises threaded holes 7 and the bracket part 5 through-holes 8 for the bolts 6. The threaded holes 7 of the first support part 1 may also be useful when the first support part 1 is to be cast into the support structure, for example, in that the first support part 1 can be fastened to the mould with bolts through the threaded holes 7.

The diameter of the through-holes 8 in the bracket part 5 is greater than the outer diameter of the bolts 6 to allow the bracket part 5 to be moved with respect to the first support part 1 when the bolts 6 have been screwed into the threaded holes 7. Instead of being round, the through-holes 8 may be made in some other shape that allows the bracket part 5 to be moved with respect to the first support part 1 when the bolts 6 have been screwed into the threaded holes 7.

In the Figures the bracket part 5 comprises a first preformed surface 9 arranged to co-operate with a second preformed surface 10 of the first support part 1. The first support part 1 is meant to be cast into the support structure such that the second preformed surface 10 forms part of the outer surface of the support structure. The first preformed surface 9 and the second preformed surface 10 are meant to transfer the forces caused by the structural element to the bracket part 5 through the first support part 1 further to the support structure. In the Figures the first preformed surface 9 is grooved, the second preformed surface 10 being provided with corresponding grooves.

The second support part 4 shown in the Figures comprises a support plate part 11 arranged to bear against the bracket part 5 when the structural element is supported on the support structure. The support plate part 11 comprises a recess 12 for the bracket part 5. The recess 12 is preferably dimensioned and shaped to allow the bracket part 5 placed in the recess 12 to move therein. This enables the moving of the structural element supported by the bracket part 5.

The support plate part 11 and the bracket part 5 comprise mating surfaces, which are at least partly curved. Consequently, structural twisting and torsion, for example, do not cause a point load, but the load is evenly distributed on the entire surface.

The support plate part 11 preferably comprises adjustment means for adjusting the structural element and for fastening it substantially immovably with respect to the bracket part 5 and thereby the support structure. In the Figures these adjustment means comprise adjustment bolts 19 mounted into threaded sleeves 20, the bolts setting themselves on opposite sides of the bracket parts 5 where they are tightened. Since the recess 12 shown in the Figures is dimensioned and shaped to allow the bracket part 5 placed in the recess 12 to move therein, the structural element can be moved with respect to the support structure by tightening and loosening the adjustment bolts 19. If the bracket part 5 is slanting, a support structure can thus be straightened by winding, for example. Moreover, the adjustment bolts 19 prevent the support structure from turning about its longitudinal axis.

The second support part 4 shown in the Figures further comprises a casing part 15 for providing a recess 16 in the structural element. The support plate part 11 is fastened to the casing part 15 to form a part of the casing part 15 serving as the recess 16.

If the structural element is made of steel, the support plate part 11 may be fastened to the structural element by welding, for example, or it may be a part formed to the structural element 11.

The first support part 1 preferably comprises a stopper 17 arranged to secure the structural element on the bracket part 5. The stopper 17 is also meant to transfer horizontal forces acting in the structure.

When seen from the direction of the support structure, the stopper 17 shown in the Figures is arranged to set behind the support plate part 11 belonging to the second support part 4.

The stopper 17 of the Figures is a separate part attached with bolts 6 to the bracket part 5, the same bolts being used for fastening the stopper 17 and the bracket part 5 to the first support part 1. To allow the stopper 17 to be made as thin as possible and the load acting on the bolts 6 as small as possible, the force in the brackets shown in the Figures may be transferred by means of a lug 18 provided on the side of the stopper 17.

It is apparent to a person skilled in the art that as technology advances the basic idea of the invention may be implemented in various ways. The invention and its embodiments are therefore not restricted to the above examples, but they may vary within the scope of the claims.

The invention claimed is:

1. A bracket for supporting a structural element on a support structure of a building, the bracket comprising:

a first support part which is cast at least partly into the support structure;

a bracket part for supporting the structural element so that the structural element supported on the bracket part bears against the support structure;

the first support part comprising threaded holes for bolts and the bracket part comprising through-holes through which the bolts are driven;

the bracket part being movably fastened with the bolts to the first support part, which is cast at least partly into the support structure, such that the position of the bracket part with regard to the support structure can be changed, wherein the inner diameter of the through-holes is greater than the outer diameter of the bolts such that when the bolts have been screwed into the threaded holes, the bracket part can be moved with regard to the first support part, wherein the bracket part comprises a first preformed surface which is arranged to co-operate with a second preformed surface of the first support part, wherein said bracket further comprises a support plate part arranged to bear against the bracket part when the structural element is supported on the support structure, and wherein the support plate part comprises a recess for the bracket part.

2. A bracket for supporting a structural element on an upwardly extended support structure of a building, the bracket comprising:

a first support part which is cast at least partly into the support structure;

a bracket part having an upwardly facing surface for supporting the structural element so that the structural element supported on the upwardly facing surface of the bracket part bears against the support structure; and a support plate part arranged to bear against the bracket part when the structural element is supported on the support structure, the first support part comprising threaded holes for bolts and the bracket part comprising through-holes through which the bolts are driven, the bracket part being movably fastened with the bolts to the first support part, which is cast at least partly into the support structure, such that the position of the bracket part with regard to the support structure can be changed, wherein the inner diameter of the through-holes is greater than the outer diameter of the bolts such that when the bolts have been screwed into the threaded holes, the bracket part can be moved with regard to the first support part, and wherein the support plate part comprises adjustment means for adjusting the structural element and for fastening it substantially immovably with regard to the bracket part.

3. A bracket for supporting a structural element on an upwardly extended support structure of a building, the bracket comprising:

a first support part which is cast at least partly into the support structure;

a bracket part having an upwardly facing surface for supporting the structural element so that the structural element supported on the upwardly facing surface of the bracket part bears against the support structure; and a support plate part arranged to bear against the bracket part when the structural element is supported on the support structure;

the first support part comprising threaded holes for bolts and the bracket part comprising through-holes through which the bolts are driven, the bracket part being movably fastened with the bolts to the first support part, which is cast at least partly into the support structure, such that the position of the bracket part with regard to the support structure can be changed, wherein the inner diameter of the through-holes is greater than the outer diameter of the bolts such that when the bolts have been screwed into the threaded holes, the bracket part can be moved with regard to the first support part, wherein the bracket part comprises a first preformed surface which is arranged to co-operate with a second preformed surface of the first support part, wherein the support plate part comprises adjustment means for adjusting the structural element and for fastening it substantially immovably with regard to the bracket part.

* * * * *